United States Patent [19]

Farmer, Jr. et al.

[11] Patent Number: 4,740,184

[45] Date of Patent: Apr. 26, 1988

[54] GETTER FLASHING DEVICE

[75] Inventors: Felta C. Farmer, Jr., Gas City; William J. Timmons, La Fontaine; Raymond C. Paull, Marion, all of Ind.

[73] Assignee: RCA Licensing Corporation, Princeton, N.J.

[21] Appl. No.: 24,193

[22] Filed: Mar. 10, 1986

[51] Int. Cl.[4] ..... H01J 9/00

[52] U.S. Cl. ..... 445/60; 219/10.57

[58] Field of Search ..... 445/19, 41, 55, 60, 445/62, 63; 219/10.57

[56] References Cited

U.S. PATENT DOCUMENTS 4,335,926 6/1982 Griesemer ..... 445/55

4,573,935 3/1986 Wardell ..... 445/63

4,584,449 4/1986 Timmons ..... 219/10.57

*Primary Examiner*—Kurt Rowan

*Attorney, Agent, or Firm*—E. M. Whitacre; D. H. Irlbeck; L. L. Hallacher

[57] ABSTRACT

A getter flashing device includes low friction sloping guide numbers which direct a CRT toward a yoke. The yoke has a conical aperture which receives the funnel portion of the CRT. The wide end of the conical aperture forms a reference edge to position the getter within the CRT at a particular location. The yoke slideable supports a coil at the preselected location. The yoke is pivotable to bring the coil and the getter into substantial planar parallelism and to substantially center the getter with respect to the coil.

8 Claims, 2 Drawing Sheets

GETTER FLASHING DEVICE

BACKGROUND

This invention relates generally to cathode ray tube (CRT) production and particularly to a readily changeable getter flashing device for such production.

During the manufacture of a cathode ray tube (CRT) a getter is disposed within the tube. The getter includes a metallic container held at one end of an elongated resilient spring whereby the getter extends into a funnel portion of the tube. After the tube is exhausted of gases and hermetically sealed, the getter material is quickly heated to vaporize, or flash, and deposit a film of getter material on the internal surface of the tube. The getter material, typically a barium aluminum alloy, has the property of sorbing gases which remain after the tube is exhausted, or gases which are later released by the walls and other structural components within the tube. The getter material, in effect, acts as an auxiliary pump to provide the high vacuum needed for effective tube operation.

The getter material is flashed by positioning a radio frequency (rf) coil in the proximity of the getter. In order to optimize vaporization of the getter material, the heating coil must be properly located and oriented with respect to the getter. Accordingly, the planes of the getter and the coil should be parallel and the coil and getter should be centered. The coil location and orientation are critical because the power delivered to the getter container varies with the inverse square of the distance between the coil and the container. Planar alignment between the getter and the coil is also critical to assure the proper interception of the transverse electrical field which heats the getter material. Improper orientation or location of the heater coil can cause severe localized heating and melt, or soften, the getter container, or the support spring and result in an unsatisfactory getter flash.

Typically CRT's are identified by a deflection angle, such as 90°, 100° or 110°. The deflection angle is the total angle through which the electron beam is horizontally scanned during the operation of the tube. For tubes of a particular deflection angle, the getters ordinarily are located at substantially the same location within the tubes. For this reason is possible to accurately orient and locate the getter in the proximity of the heating coil without attempting to detect the location of the getter. However, CRT's with different deflection angles typically have the getter located at different locations within the tube. For this reason as different tubes come down an assembly line it is necessary to change the getter flashing device in order to properly locate and orient the getters with respect to the heating coils. For this reason, there is a need for a getter flashing device which permits the rapid and ready changing of the tube orientating and locating mechanism while permitting the accurate location and orientation of the tubes with respect to the flashing coil. The present invention fulfills this need.

SUMMARY

A device for flashing a getter in a cathode ray tube (CRT) having a neck and a funnel portion includes a yoke for receiving the CRT tube. The yoke includes a conical aperture for engaging the funnel portion of the CRT. The wide opening of the aperture forms a reference edge for engaging the funnel portion whereby the getters of various tube sizes are located at a preselected location. The yoke is pivotably supported above a support platform. A plurality of guide numbers is affixed to the support platform in the proximity of the yoke. The guide numbers slope toward the yoke, and converge toward the yoke, whereby CRT's placed on the guide members slide toward the yoke and the neck enters the aperture so that the yoke pivots and engages the funnel portion along the reference edge to position a getter within the CRT at the preselected location. An r-f coil is arranged in the proximity of the aperture and is carried by the yoke whereby the center of the coil is positioned in the proximity of the preselected location.

DETAILED DESCRIPTION

Figure 1:
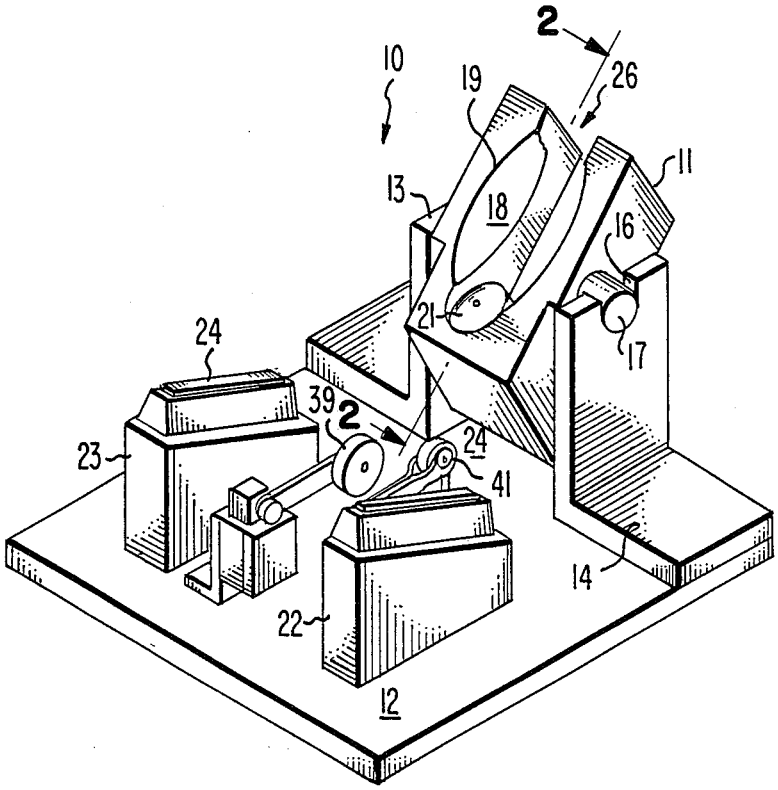
FIG. 1 is an isometric of a preferred embodiment.

In FIG. 1, the getter flashing device 10 includes a yoke 11 which is pivotably supported above a substantially horizontal support platform 12 by posts 13 and 14. The posts 13 and 14 include a slot 16 which is open at the top of the post. The sides of the yoke 11 include pins, such as 17, which set in the slots to pivotably support the yoke 11 above the platform 12.

The yoke 11 includes a conical aperture 18 the wide opening of which forms a reference edge 19. The yoke 11 supports an rf heating coil 21, which when energized produces rf energy to heat the getter material and cause the material to vaporize and coat the internal surface and components of the tube.

Guide members 22 and 23 are fixed to the platform 12. The guide members 21 and 23 slope downwardly toward the yoke 11 and also converge inwardly toward the yoke 11. The edges 24 of the guide members 22 and 23 are covered with a low friction material. A CRT is placed onto the low friction edges 24 of the guide members 22 and 23, either manually or by an automatic mechanism, and gravity causes the tube to slide downwardly toward the yoke 11. The yoke 11 includes a slot 26 which enables the neck of tube to enter the conical aperture 18. The yoke 11 is pivotable and therefore the yoke 11 pivots to the position needed to orient the heating coil 21 in the desired orientation with respect to the getter contained within the tube. The conical aperture 18, within the yoke 11, has a diameter at the reference edge 19 which is selected to engage a tube of a particular deflection angle such that the getter within the tube is located in the close proximity of the heating coil 21 and the planes of the coil 21 and getter are substantially parallel.

Figure 2:
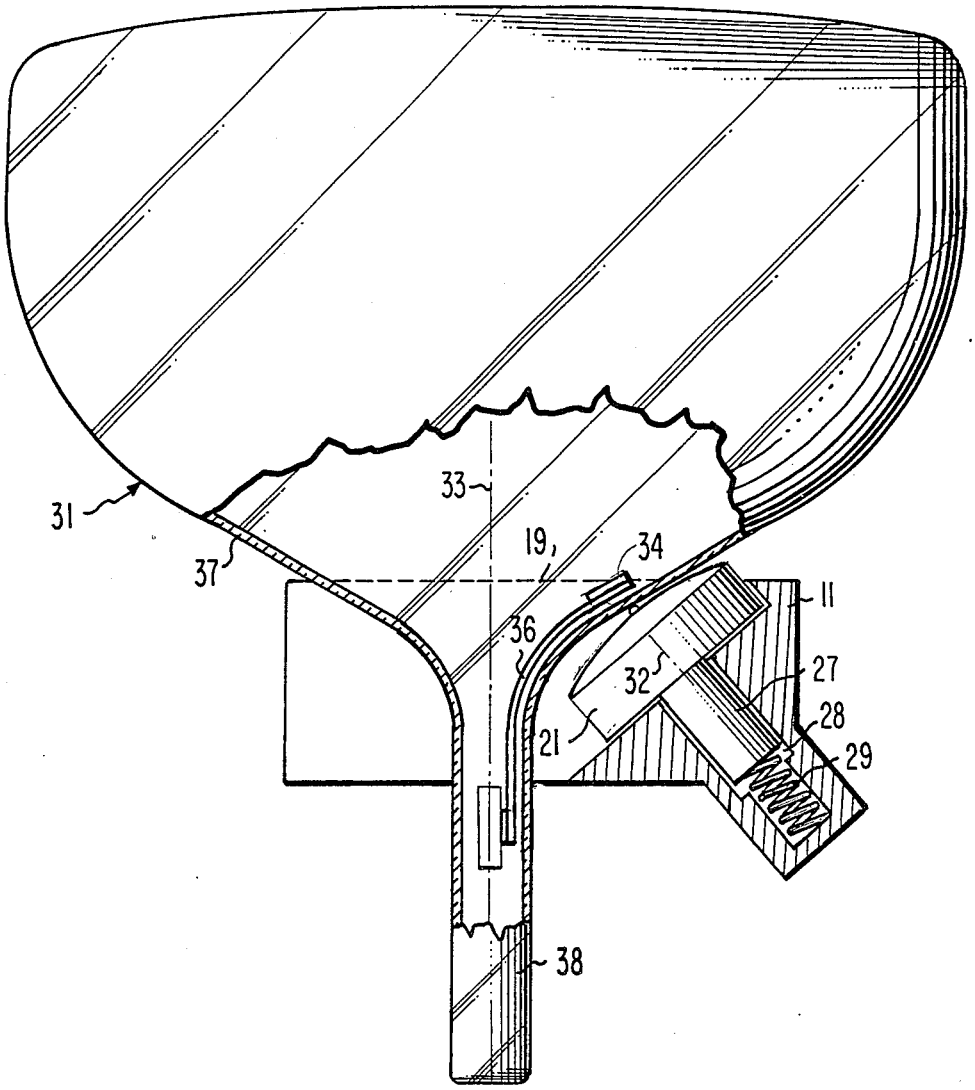
FIG. 2 is a cross section taken along line 2—2 of FIG. 1.

In FIG. 2 the heating coil 21 includes a stem 27 which is received by a bore 28 within the yoke 11. The stem 27 and bore 28 are dimensioned and configured so that the stem is readily slideable within the bore 28. Also, the bore 28 is deeper than the stem 27 is long to permit the sliding of the stem within the bore. A spring 29, such as a coil spring, biases the heating coil 21 outwardly from the yoke 11 toward a tube 31 which rests within the yoke 11. The stem 27 and bore 28 have a longitudinal axis 32 which is angularly disposed with respect to the axis 33 of the conical aperture 18. Accordingly, the plane of the coil 21 is substantially parallel to the plane of the getter 34, which is supported within the tube 31 by an elongated spring 36. The location of the getter 34 within the tube 31 is substantially the same for all tubes having a given deflection angle. However, the location is different for the tubes having different deflection angles. Accordingly, the angular disposition of the axis 32 with respect to axis 33 of the conical aperture 18 varies in accordance with the deflection angle of the tube to be flashed. Additionally, the reference edge 19 varies for different size tubes in order to accommodate tubes of different deflection angles to accurately orient and position the heater coil 21 with respect to the getter 34.

In operation, a tube 31 is placed upon the guide members 22 and 23 with the neck 38 of the tube facing the yoke 11. Because of the low friction material on the edges 24 of the guide members 22 and 23 the tube slides toward the yoke 11 and the neck 38 passes through the slot 26 as the tube 31 enters the conical aperture 18. The yoke 11 pivots on the pins 17 in the slots 16 to cause the heating coil 26 to rotate toward the tube to bring the plane of the coil 26 into substantial parallelism with the plane of the getter 34 within the tube 31. The funnel portion 37 of the tube 31 engages the reference edge 19, which is the wide opening of the conical aperture 18 in the yoke 11, to further assure the proper orientation and location of the center of the coil 21 and the getter 34, so that both the center of the coil 21 and the getter 34 are located at a desired preselected location. When tubes of a different deflection angle are to be getter flashed the yoke 11 is easily removable from the posts 13 and 14 merely by lifting the yoke to disengage the pins 17 from the slots 16. Additionally, the heater coil 21 is easily removed from the bore 28 within the yoke 11 simply by lifting the coil 21 out of the bore. A yoke having the desired conical opening and reference edge 19 for the next tube deflection angle to be getter flashed can be inserted into the device merely by placing the stem 27 of the coil 21 into the bore 28 of the replacement yoke 11. The replacement yoke is placed in the getter flash device 10 by placing the pins 17 of the replacement yoke 11 in the slots 16 of the posts 13 and 14.

A plurality of sensor switches 39 and 41 are arranged between the guide numbers 22 and 23. The sensor switch 39 senses the presence of a tube between the guides 22 and 23 to prohibit energization of the coil 21 in the absence of a tube. The switch 41 is a small size tube detection switch to assure that a tube of the 13 inch diagonal size is properly flashed with the proper power setting. When a tube of the 13 inch size is present on the guide numbers 22 and 23 the tube causes the switch 41 to close the coil 21 is energized to a lower power level. This is done because 13 inch tubes use a lower mass getter and require less power for the desired degree of heating. The positioning of switch 41 is such that only 13 inch tubes close the switch.

What is claimed is:

1. A device for flashing a getter in a cathode ray tube (CRT) having a neck and a funnel portion comprising:

a yoke for receiving said CRT tube, said yoke having a conical aperture for engaging said funnel portion, the wide opening of said aperture forming a reference edge for engaging said funnel portion whereby the getters of various tube sizes are located at a preselected location;

means for pivotably supporting said yoke above a support platform, said means for supporting including a plurality of posts affixed to said platform, each of said posts including an open slot, said yoke including a plurality of pins extending from the sides, said slots receiving said pins whereby said yoke is readily changeable;

a plurality of guide members affixed to said support platform in the proximity of said yoke, said guide members sloping toward said yoke, and converging toward said yoke, the edges of said guide numbers which engage said CRT being covered with a low friction material, whereby CRT's placed on said guide members slide toward said yoke and said neck enters said aperture so that said yoke pivots and engages said funnel portion along said reference edge to position a getter within said CRT at said preselected location, an r-f coil arranged in the proximity of said aperture and carried by said yoke whereby the center of said coil is positioned in the proximity of said preselected location;

said coil including a stem, and said yoke including a bore dimensioned and configured to slideably receive said stem whereby said coil is readily inserted into and removed from said yoke.

2. The device of claim 1 wherein said support platform is substantially horizontal, and wherein said guide numbers slope with respect to said platform, said yoke being arranged at the low end of said guide numbers whereby gravity feeds said CRT to said yoke.

3. The device of claim 2 wherein said bore is angularly disposed with respect to the axis of said conical aperture whereby the plane of said coil is substantially parallel to the plane of said getter.

4. The device of claim 3 wherein said conical aperture is angled substantially the same as the deflection angle of a particular CRT whereby said yoke is specific to a particular deflection angle of CRT.

5. The device of claim 4 wherein said stem and said bore are dimensional whereby said coil is movable with respect to said conical aperture.

6. The device of claim 5 wherein said coil is spring biased in said bore.

7. The device of claim 6 further including at least one sensor switch for preventing energization of said coil in the absence of a CRT.

8. The device of claim 7 further including an additional sensing switch for sensing the presence of small tubes.

* * * * *